US010487573B2

(12) United States Patent
Bohlen

(10) Patent No.: US 10,487,573 B2
(45) **Date of Patent: *Nov. 26, 2019**

(54) SHADING DEVICE FOR AN ARCHITECTURAL OPENING AND METHOD FOR ADJUSTING AN END STOP POSITION OF THE SHADING DEVICE

(71) Applicant: Hunter Douglas Industries B.V., Rotterdam (NL)

(72) Inventor: Jorg Bohlen, Langen (DE)

(73) Assignee: HUNTER DOUGLAS INDUSTRIES B.V., Rotterdam (NL)

( * ) Notice: Subject to any disclaimer, the term of this patent is extended or adjusted under 35 U.S.C. 154(b) by 178 days.

This patent is subject to a terminal disclaimer.

(21) Appl. No.: 15/447,462

(22) Filed: Mar. 2, 2017

(65) Prior Publication Data

US 2017/0175440 A1 Jun. 22, 2017

Related U.S. Application Data

(63) Continuation of application No. 14/591,673, filed on Jan. 7, 2015, now Pat. No. 9,617,787.

(30) Foreign Application Priority Data

Jan. 8, 2014 (NL) ..... 1040593

(51) Int. Cl.
*E06B 9/50* (2006.01)
*E06B 9/80* (2006.01)
(Continued)

(52) U.S. Cl.
CPC ..... *E06B 9/50* (2013.01); *E06B 9/42* (2013.01); *E06B 9/44* (2013.01); *E06B 9/60* (2013.01);
(Continued)

(58) Field of Classification Search
CPC ..... E06B 9/42; E06B 9/44; E06B 9/50; E06B 9/60; E06B 9/68; E06B 9/78; E06B 9/80; E06B 9/88
See application file for complete search history.

(56) References Cited

U.S. PATENT DOCUMENTS 1,366,884 A 1/1921 Nahrung
1,725,285 A * 8/1929 Lalonde ..... E06B 9/88 160/295

(Continued)

FOREIGN PATENT DOCUMENTS

EP 2216492 A1 8/2010
WO 2010/089118 A1 8/2010
WO 2013/129915 A1 9/2013

OTHER PUBLICATIONS

Netherlands Search Report and Written Opinion dated Sep. 26, 2014, Application No. NO138987, 9 Pages.

*Primary Examiner* — Katherine W Mitchell
*Assistant Examiner* — Abe Massad

(57) ABSTRACT

The invention relates to a shading device for an architectural opening comprising a shade, a drive unit for extending and retracting the shade between a first and second end position, a spindle, a first end stop, stationary connected to the spindle near a first end of the spindle and at least one travelling nut, movably arranged on the spindle and operatively connected to the drive unit so as to move towards, respectively away from the first end stop as the shade is extended, respectively retracted. The travelling nut is articulated in circumferential direction into segments, with at least two segments being detachably connectable to each other at one of their ends.

13 Claims, 13 Drawing Sheets

(51) Int. Cl.

| | |
|---|---|
| ***E06B 9/68*** | (2006.01) |
| ***E06B 9/42*** | (2006.01) |
| ***E06B 9/88*** | (2006.01) |
| ***E06B 9/44*** | (2006.01) |
| ***E06B 9/60*** | (2006.01) |
| ***E06B 9/78*** | (2006.01) |

(52) U.S. Cl.
CPC ..... *E06B 9/68* (2013.01); *E06B 9/78* (2013.01); *E06B 9/80* (2013.01); *E06B 9/88* (2013.01)

(56) References Cited

U.S. PATENT DOCUMENTS

| | | | | | |
|---|---|---|---|---|---|
| 2,229,221 | A | | 1/1941 | Pratt | |
| 2,678,094 | A | | 5/1954 | Sargent | |
| 4,482,137 | A | * | 11/1984 | Gavagan | B60R 5/047 160/315 |
| 5,015,013 | A | | 5/1991 | Nadin | |
| 5,779,418 | A | | 7/1998 | Ying-Che | |
| 6,467,714 | B1 | * | 10/2002 | Rasmussen | E06B 9/44 160/296 |
| 7,540,315 | B2 | | 6/2009 | Chen | |
| 8,272,083 | B1 | | 9/2012 | Liston et al. | |
| 9,617,787 | B2 | * | 4/2017 | Bohlen | E06B 9/80 |
| 2010/0212843 | A1 | | 8/2010 | Bohlen et al. | |
| 2011/0139380 | A1 | | 6/2011 | Anthony et al. | |
| 2013/0153161 | A1 | * | 6/2013 | Haarer | E06B 9/42 160/293.1 |
| 2015/0191973 | A1 | | 7/2015 | Bohlen | |
| 2015/0376941 | A1 | | 12/2015 | Fujita et al. | |
| 2018/0155984 | A1 | * | 6/2018 | Jay | E06B 9/88 |

* cited by examiner

SHADING DEVICE FOR AN ARCHITECTURAL OPENING AND METHOD FOR ADJUSTING AN END STOP POSITION OF THE SHADING DEVICE

CROSS-REFERENCE TO RELATED APPLICATIONS

This application is a continuation of co-pending U.S. patent application Ser. No. 14/591,673, filed Jan. 7, 2015 and entitled "Shading device for an architectural opening and method for adjusting an end stop position of the shading device", which claims priority to Netherlands Patent Application No. 1040593, filed on Jan. 8, 2014, and entitled "Shading device for an architectural opening and method for adjusting an end stop position of the shading device", which applications are hereby incorporated in their entirety by reference as though fully disclosed herein.

FIELD

The invention relates to a shading device for an architectural opening comprising a shade, a drive unit for extending and retracting the shade between a first and second end position, a spindle, a first end stop, stationary connected to the spindle near a first end of the spindle; at least one travelling nut, movably arranged on the spindle and operatively connected to the drive unit so as to move towards, respectively away from the first end stop as the shade is extended, respectively retracted.

BACKGROUND

A respective shading device, as disclosed in applicant's European Application EP 2 216 492 A1, is equipped with a mechanical end stop system. Such mechanical end stop systems are known as so-called spindle & nut end stop systems. A spindle & nut end stop system may comprise a threaded shaft as the spindle, a wandering or travelling nut threaded on the shaft and at least one or two end stop members fixed on the shaft.

A drawback of the known mechanical end stop system is that the travelling nut has to be screwed on the spindle before installing the last end stop. This limits the amount of possible constructions of the spindle with the end stops. Particularly at least on end stop has to be releasable in regard to the spindle.

A further drawback of the known mechanical end stop system is that each end stop is designed as a separate part which needs to be fixed to the shaft such that the end positions of the shade are set as desired. Furthermore, for mounting the end stop member to the shaft a fixing means, preferably screws, pins or rivet, is needed. The end stop member may consist of two separate halves which have to be connected at the shaft. Thus, known mechanical end stop systems consist of several parts leading to a complex construction. As a consequence the assembling and/or adjusting of the shading device may be complex and time consuming.

SUMMARY

It is a principal object of the present invention to enhance a shading device as mentioned in the preceding introduction and/or a travelling nut for such a shading device such that the assembling and/or arranging of a travelling nut around and/or onto a spindle is simplified.

Preferably it is a further object of the present invention that the assembling and/or adjusting of the shading device, particularly the end stop assembly, is simplified.

It is a further object of the present invention to provide a simple method for arranging a travelling nut on and/or around a spindle.

Preferably it is a further object of the present invention to provide a simple method for adjusting the lower end stop position and/or upper end stop position of a shade providing a shade device according to the invention with at least one travelling nut moveably arranged on the spindle between the first and second end stop, whereby the first end stop, the second end stop and the spindle form an end stop assembly.

The object of the invention is accomplished by a shading device as mentioned in the preceding introduction and/or a travelling nut for such a shading device, wherein the travelling nut comprises at least two segments for arranging the travelling nut around the spindle.

As an advantageous result the travelling nut can be arranged around and/or onto a spindle in a quick and/or easy way. A travelling nut formed of at least two segments can be arranged around the spindle independent of the end stops. As the ends of the spindle may be blocked by the first and second end stop it is not possible to screw a usual nut on the spindle. Thus, the travelling nut is preferably designed such that the nut can be opened and/or closed by means of the two segments of the travelling nut. Even if the end stops are already fixed to the spindle, the travelling nut is mountable to the spindle. Preferably the travelling nut is formed as a split nut.

Preferably the shading device is a roller blind. Particularly the shade is a sheet of flexible material. The shade may be attached upon the outer surface of a winding core such as a shade tube or roller. The travelling nut may interact with a driven portion of the shading device, such as aforementioned winding core, and the spindle may be stationary such that when the shading device is driven the travelling nut rotates and is displaced in an axial direction along the spindle. The spindle is preferably a threaded rod. When the travelling nut reaches the first or second end stop the nut can no longer be displaced along the spindle. Since the driven portion of the shading device is coupled with the nut, rotation of the driven portion will be stopped too.

According to a further embodiment of the present invention the travelling nut has two segments which are hinged with each other for arranging the travelling nut onto the spindle. For the opening of the travelling nut the ring-like shape of the nut can be resolved by moving the two segments of the nut away from each other. As a result the travelling nut has an aperture with a size appropriate to accommodate the spindle in a centre of the nut. The centre of the nut has a threaded inner side which mate with a threaded outer side of the spindle. Preferably the two segments are formed as a first half and a second half of the travelling nut connected with each other by a flexible hinge. The first half, the second half and the flexible hinge may be formed as one piece and/or as one integral part, particularly made of plastic.

Preferably the travelling nut is formed in one piece comprising a flexible hinge and a connection arrangement for detachably joining the two segments of the travelling nut. Thus, the travelling nut may be arranged on the spindle and/or removed from the spindle by the detachable connection as desired. The two segments of the travelling nut may comprise engaging means for securing the segments to one another. Particularly the connection is designed as a snap connection. A snap connection does not need any further mounting elements for connecting or disconnecting the segments of the nut.

The connection arrangement may have a first joint element and a second joint element, which have complementary formations for an engagement with each other. Preferably the first joint element having a snap-on catch is assigned to a first half of the travelling nut. The second joint element may have a recess complementary formed to the snap-on catch. The second joint element may be assigned to a second half of the travelling nut.

A further embodiment of the present invention provides the travelling nut comprising at least one engaging element on the outer circumference of the travelling nut for engagement with a complementary element on the inner surface of the winding core. Preferably the engaging element of the travelling nut interacts at least during normal operation of the shading device with the complementary element such that when the winding core is rotated around its longitudinal axis the travelling nut rotates and is displaced in an axial direction along the stationary spindle.

The travelling nut may comprise several engaging elements which are equidistantly distributed over the circumference of the travelling nut. Preferably the travelling nut has at least two, three or four engaging elements. With only one single engaging element the winding core may be rotated 360° around its longitudinal axis for arranging the end stop assembly with the travelling nut arranged on the spindle within the inner cavity of the winding core. Providing several engaging elements spaced over the circumference of the nut allows inserting of the end stop assembly with the travelling nut in the inner cavity of the winding core by rotating the winding core around its axis with only a fraction of 360°. Preferably the end stop assembly with the travelling nut can be inserted into the inner cavity in rotation steps and/or angle steps of 180°, 120° or 90° of the winding core around its longitudinal axis. As a result the adjusting of the lower and/or upper end position of the shade is simplified and more precise.

Preferably when the travelling nut interacts with and/or abuts the first end stop to set the upper end position of the shade, the upper end position of the shade is adjustable by removing the end stop assembly with the at least one travelling nut from the winding core while maintaining the orientation of the end stop assembly, rotating the winding core so as to unwind or wind up the shade as desired while still maintaining the orientation of the end stop assembly, preferably the orientation of the travelling nut relative to the spindle, and re-inserting the end stop assembly with the at least one travelling nut into the inner cavity of the winding core.

The engaging element of the travelling nut may be formed as a groove. Preferably the groove is aligned parallel to the longitudinal axis of the winding core. The complementary element on the inner surface of the winding core may be formed as a bar extending parallel to the longitudinal axis of the winding core. In an alternative embodiment the travelling nut may be formed as a bar and the complementary element on the inner surface of the winding core may be formed as a groove. The bar and the groove extend parallel to the longitudinal axis of the winding core.

According to a further embodiment of the present invention a first travelling nut and a second travelling nut are moveably arranged on the spindle between the first and second end stop. By using a first and second travelling nut the adjustment possibilities for setting the lower and upper end position of the shade are increased. Preferably the first travelling nut sets an upper end position of the shade by interacting with the first end stop. The second travelling nut sets a lower end position of the shade by interacting with the second end stop. The distance between the first and the second travelling nut on the spindle defines the amount and/or the length of the shade which can be unwind from or wind up on the winding core.

According to a further embodiment the spindle length between the first end stop and the second end stop is predetermined and unalterable. As an advantageous result the spindle and the first and second end stop may form an end stop assembly as one single unit. Thus, the necessity of providing the end stops as separate parts besides the spindle can be avoided. As the first and second end stops may be already inseparably connected with the spindle any further assembling and/or adjusting of the first and second end stops can be omitted. This allows a simplified assembling and/or adjusting of the shading device, particularly the end stop assembly.

Preferably the first end stop and the second end stop are inseparably connected with the spindle. The first end stop, the second end stop and the spindle may be formed in one piece or made as one integral part. Such an end stop assembly can be produced with reasonable costs. The end stop assembly consisting of the first end stop, the second end stop and the spindle may be made of plastic. The result is a single part or component including the spindle and the first and second end stop which is compact and space-saving. Preferably the first end stop and the second end stop are formed as opposing ends of the spindle. The length of the spindle between the first and second end stop is fixed and unchangeable. The first and/or second end stop may have a greater diameter than the spindle. The circumference of the first and/or second end stop may protrude over the circumference of the spindle. Thus, the inner sides of the first and/or second end stop oriented towards the spindle may serve as contact surfaces for the travelling nut or may have an abutment shoulder for interacting with a complementary abutment projection of the travelling nut.

The first end stop, the second end stop and the spindle may form an end stop assembly. The end stop assembly in regard to the first end stop, the second end stop and the spindle may be produced as one piece and/or one integral component. Preferably at least one travelling nut is part of or arranged on the end stop assembly. Particularly a first travelling nut and a second travelling nut are parts of or arranged on the end stop assembly. The end stop assembly may be arranged to a fixed rod or shaft. During normal operation of the shading device the rod or shaft is stationary. As the end stop assembly is non-rotatable mounted to the stationary rod or shaft, the end stop assembly itself is stationary. Preferably the winding core is rotatable mounted around the end stop assembly. By rotating the winding core in a first direction a flexible cord or shade material can be unwound from the winding core. Rotating the winding core in a second direction and directed opposite the first direction winds the cord or shade up around the winding core.

The end stop assembly may be formed as module. This module can be a component of a modular system for combining with components of the modular system. Preferably the components of the modular system which are combinable with the end stop assembly are stationary. A component of the modular system may be a rod, a counterbalance unit and/or a drive means. The modular system may allow for arranging all drive means for driving the winding core located at one end of the shading device. Preferably the components of the modular system, particularly at the end with the drive means, are designed such that they are stationary during normal operation of the shading device. The components may have a stationary point and/or a stationary central axis.

Preferably the first end stop and/or the second end stop each have an end stop connector for connecting the first end stop and/or the second end stop with a separate component. Because of the end stop connectors the end stop assembly is usable as a module which can be combined with other components of a modular system. The end stop connector may be formed as an opening. Preferably the first end stop, the second end stop and the spindle have a channel extending from an end stop opening of the first end stop to an end stop opening of the second end stop. Particularly the end stop openings and/or the channel have inner formations which mate with outer formations of a rod for non-rotatable fixing to the rod. Caused by the mating formations the end stop assembly is non-rotatable fixed relative to the rod. Furthermore, the end stop assembly may be also fixed by the mating formations in regard to prevent an axial movement.

According to a further embodiment of the present invention an end piece is arranged at an end of the winding core for mounting the winding core to a holding element. The end piece may be at least partly inserted into the inner cavity of the winding core. Preferably the holding element is mountable to a building structure. A building structure may be a wall, a ceiling and/or a reveal. The building structure may surround or define the architectural opening. Preferably the architectural opening is a window. The holding element may comprise a bracket.

Preferably the end piece and the holding element have correspondingly designed fixing elements for realizing a non-rotating connection of the end piece with the holding element. The end piece may be stationary attached to the stationary holding element. Preferably by realizing the connection of the end piece with the holding element the spindle is non-rotatable mounted to the holding element. As the end piece is non-rotatable mounted to the end stop assembly, the first and second end stop as well as the spindle of the end stop assembly are also stationary. The fixing elements may be designed as snap-on fittings allowing quick engagement and disengagement of the correspondingly designed fixing elements. A first fixing element may be formed as a protrusion and a second fixing element may be formed as a recess for accommodating a protrusion and realizing a form-fitting connection. A first fixing element may be assigned to the end piece and a second fixing element may be assigned to the holding element or vice versa.

According to a further aspect of the invention a bearing is assigned to the end piece. The bearing allows rotational movement of the winding core around the non-rotating end piece and the non-rotating spindle. Preferably the bearing is mounted to the outer surface of the end piece which interacts with the inner surface of the winding core. The end piece may be mounted to the winding core exclusively via the bearing.

Advantageously the end piece is connectable to the holding element in either one of several different orientations of the end piece relative to the holding element. By providing the possibility of several different orientations in which the end piece is connectable with the holding element an adjusting of the lower and/or upper end stop position of the shade is simplified and more precise. Preferably the end piece and the holding element have several correspondingly designed fixing elements or fixing means equidistantly and coaxially distributed around the longitudinal centre axis of the winding core defining several discrete and equally distanced holding positions of the end piece in interaction with the holding element. Thus, the winding core with the end piece and the end stop assembly may be rotated around the longitudinal centre axis of the winding core with discrete rotation steps and/or angle steps.

Preferably the end piece and the holding element provide at least four, six, eight, ten or twelve correspondingly designed fixing elements or fixing means which are equidistantly and coaxially distributed around the longitudinal axis of the winding core for defining accordingly discrete and equally distanced holding positions. Thus, the different holding positions may be distanced from each other according a rotation of the end piece and/or winding core around the longitudinal axis of the winding core in angle increments of 90°, 60°, 45°, 36° or 30°.

The first fixing element of the end piece may have a stick with grooves as fixing means on its outer surface aligned parallel the longitudinal axis of the stick. The second fixing element of the holding element may have a recess with bars as fixing means formed complementary to the grooves of the first fixing element.

According to a further embodiment of the present invention the first end stop and/or the second end stop are arranged on a stationary rod of a counterbalance unit. Preferably the first end stop or the second end stop interacts with the counterbalance unit for providing a preload for the counterbalance unit, particularly in an upper end position of the shade. The first or second end stop may interact with a pre-tensioned spring element of the counterbalance unit to hold the preload or pre-tensioning. The counterbalance unit may be generally similar to a counterbalance unit described in the applicant's published international applications WO 2010/089118 or WO 2013/129915.

Another aspect of the invention is related to a method for arranging a travelling nut according to present invention around and/or onto a spindle. According to this method the outer circumference of the travelling nut is opened in a first step by separating two segments of the travelling nut. This may be achieved by opening the ring-like shape of travelling nut by displacing the two segments. In a next step the travelling nut and/or the two segments are arranged around the spindle. In a further step the two segments are connected with each other for closing the ring-like shape and/or the outer circumference of the travelling nut.

The invention is also related to a method for adjusting the lower end stop position and/or upper end stop position of a shade providing a shade device according to the present invention with at least one travelling nut moveably arranged on the spindle between the first and second end stop, whereby the first end stop, the second end stop and the spindle form an end stop assembly. The method comprises the step of arranging the winding core having an end piece to a holding element mounted to a building structure. The winding core may be rotatable connected to the end piece by a bearing. Furthermore, the end piece may be non-rotatable connected to the spindle and/or end stop assembly. By arranging the end piece to the stationary mounted holding element, the end piece and the spindle, particularly the end stop assembly, is stationary.

The method further comprises the step of rotating the winding core to the lower end stop position of the shade at which the travelling nut interacts with the second end stop of the spindle. The travelling nut is connected with the inner surface of the hollow winding core such that rotating the winding core rotates the travelling nut around the spindle, which leads to a movement of the travelling nut along the longitudinal direction of the spindle axis. In a next step the end piece is disengaged from the holding element. Preferably the whole winding core is removed from any holding elements. According to a further step the winding core is rotated together with the end stop assembly around its longitudinally axis for rolling up or rolling off the shade from the winding core to set the desired shade length. In a following step the connection between the end piece and the holding element is re-established. This method allows a quick and easy way to adjust at least one end stop position of the shade.

Preferably the travelling nut during rotating of the winding core together with the end stop assembly remains its position in relation to the spindle and the second end stop. To set the desired shade length and/or an end stop position of the shade, the winding core including the end stop assembly is rotated around the longitudinal axis of the winding core. For the adjusting step there is no movement of the winding core relative to the spindle, particularly the end stop assembly. Thus, the travelling nut does not move relative to the spindle and remains abutting the second end stop.

According to a further embodiment of the method and before arranging the winding core with the end piece to the holding element, the end stop assembly is inserted into the inner cavity of the winding core with the shade in its upper end position. Preferably at least one travelling nut interacts with and or abuts the first end stop.

Preferably a first travelling nut and a second travelling nut are moveably arranged on the spindle between the first and second end stop. The distance between the first and second travelling nut sets the total length of the shade which may be wind onto or unwind from the winding core. The first travelling nut may be assigned to the first end stop for setting the upper end position of the shade. The second travelling nut may be assigned to the second end stop for setting the lower end position of the shade.

BRIEF DESCRIPTION OF THE DRAWINGS

The following detailed description, given by way of example and not intended to limit the present invention solely thereto, will best be appreciated in conjunction with the accompanying figures, wherein like reference numerals denote like elements and parts, in which.

DETAILED DESCRIPTION

The present invention will now be described more fully hereinafter with reference to the accompanying figures in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 1:
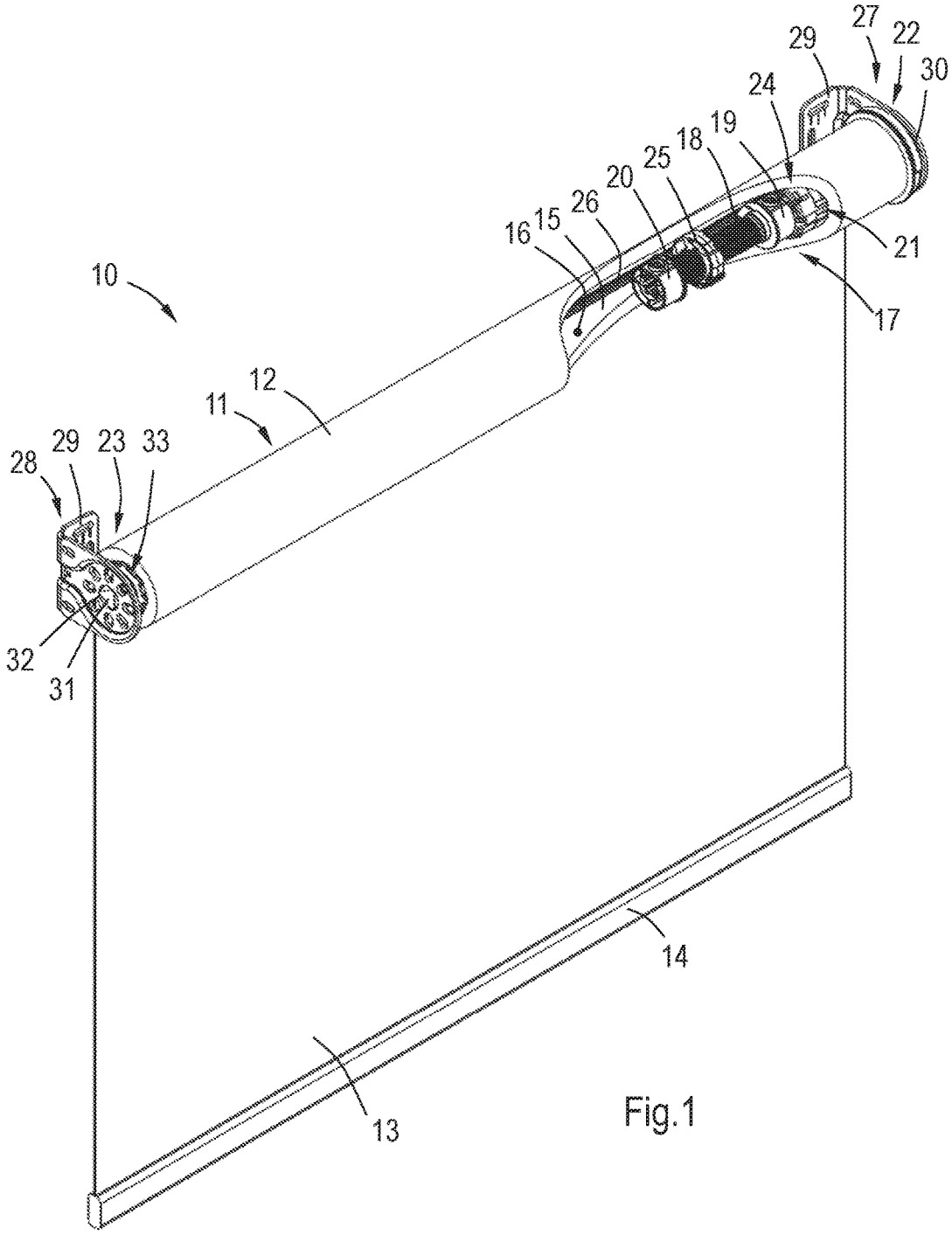
FIG. 1 is a schematic perspective view with partial removed elements of a shading device according to the present invention.

FIG. 1 is a schematic perspective view with partial removed elements of a shading device 10 according to the present invention and shows the shading device 10 assembled for normal operation. According to this embodiment the shading device 10 is a roller blind. The shading device 10 comprises a winding core, more particularly a shade tube 11. The shade tube 11 is designed as a roller. On an outer surface 12 of the shade tube 11 a shade 13 is attached. The shade 13 is made of a flexible material that can be rolled up and rolled down the shade tube 11. A free end of the shade 13 has a bottom rail 14 for stabilizing the shade 13 and/or operating the shade 13 by hand.

The shade tube 11 is hollow and has an inner surface 15 defining an inner cavity 16. Within the inner cavity an end stop assembly 17 is arranged. The end stop assembly 17 comprises a spindle 18, a first end stop 19 and a second end stop 20. In this embodiment the first and second end stop 19, 20 are formed integrally with the spindle 18.

The end stop assembly 17 is mounted to an end piece 21. Here the first end stop 19 is arranged adjacent to the end piece 21. The shade tube has a first tube end 22 and a second tube end 23. The end piece 21 is inserted in the inner cavity 16 of the shade tube 11 at the first tube end 22. The end piece 21 and the end stop assembly 17 are non-rotatable mounted to each other. A bearing 24 is arranged at the end piece 21 connecting the end piece 21 with the inner surface 15 of the shade tube 11. Thus, the shade tube 11 is rotatable relative to the end piece 21 and the end stop assembly 17.

A travelling nut 25 is moveably arranged on the spindle 18 between the first and second end stop 19, 20. With an engaging element on the outer surface the travelling nut 25 interacts with a complementary element 26 on the inner surface 15 of the shade tube 11. In this embodiment the complementary element 26 is designed as a bar extending parallel to the longitudinal axis of the shade tube 11.

The first and second tube ends 22, 23 are respectively coupled to first and second holding elements 27, 28. Each of the holding elements 27, 28 comprises a bracket 29 for mounting to a building structure. Furthermore, holding element 27 assigned to the end piece 21 of the first tube end 22 has a mounting disc 30. In this embodiment the mounting disc 30 comprises a drive means for driving the shade tube 11. The mounting disc 30 has a stationary recess which is non-rotatable fixed to the bracket 29 while the drive means of the mounting disc 30 is rotatable relative to the recess. The end piece 21 has a stick which is also non-rotatable connected to the mounting disc 30, namely to the recess of the mounting disc 30. Thus, the end stop assembly 17 is mounted via the end piece 21 to the holding element 27.

The second tube end 23 has a stationary axle stub 31 extending out of the inner cavity 16 of the shade tube 11. The axle stub 31 and the end piece 21 forms a rotation axis of the shade tube 11 around the longitudinal centre axis of the shade tube 11. The axle stub 31 is non-rotatable coupled to the bracket 28 by an appropriate complementary mating formation 32. The axle stub 31 is coupled by a further bearing 33 to the inner surface 15 of the shade tube 11. The further bearing 33 is inserted in the inner cavity 16 of the shade tube 11 at the second tube end 23. The bearing 33 allows rotation of the shade tube 11 relative to the stationary axle stub 31.

Figure 2:
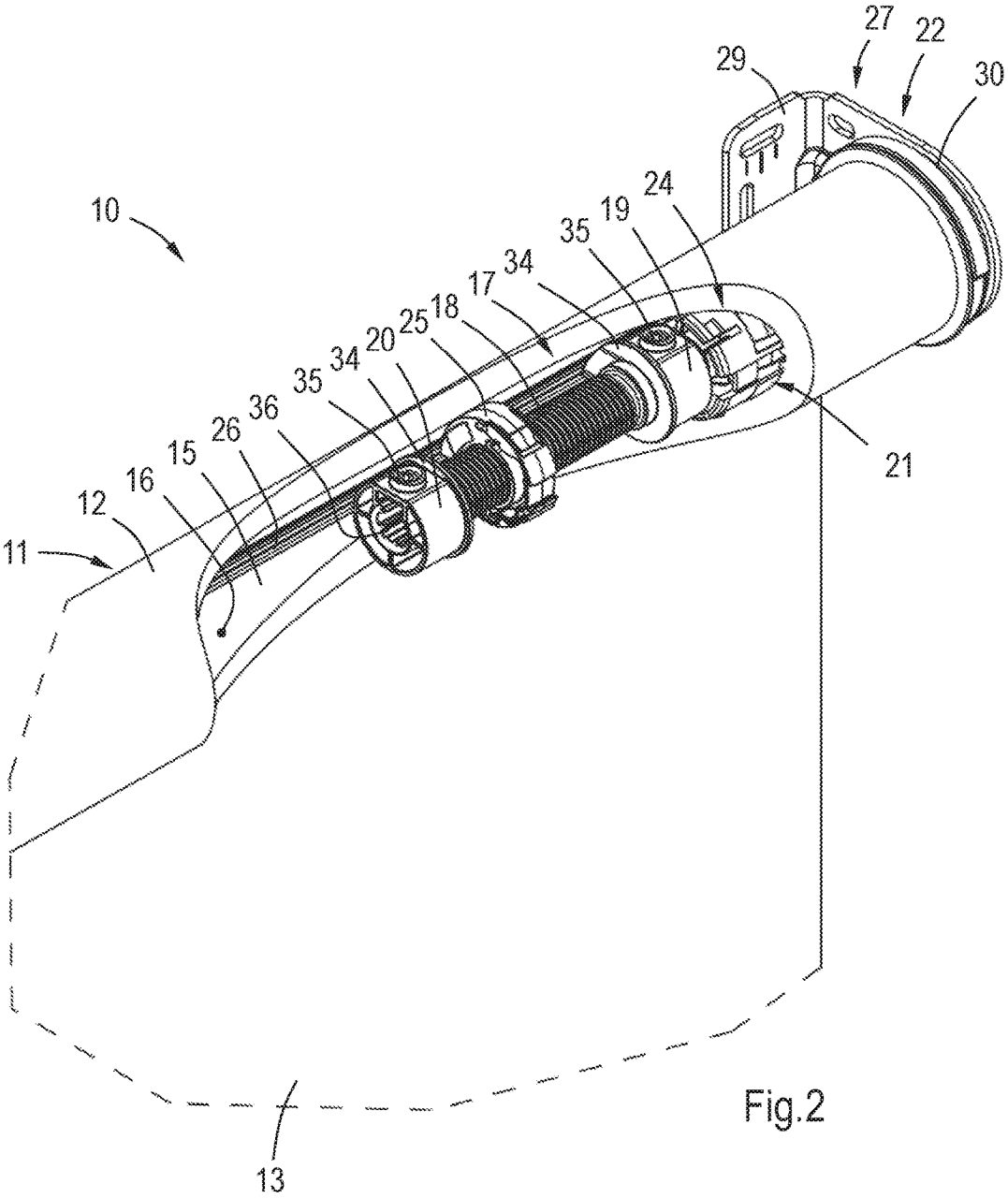
FIG. 2 presents a schematic perspective view of a section with partial removed elements of the shading device according to FIG. 1.

FIG. 2 presents a schematic perspective view of a section with partial removed elements of the shading device 10 according to FIG. 1. The spindle 18 is a threaded shaft. In this embodiment the spindle 18 is hollow to accommodate an end of a stationary rod (not shown). This rod may be an extension of axle stub 31 according to FIG. 1 or a rod of a counterbalancing unit. The external thread of spindle 18 mates with the internal thread of travelling nut 25.

The first and second end stops 19, 20 are forming end parts of the spindle 18. Furthermore, the first and second end stops 19, 20 have a greater diameter than the spindle 18. Inner sides 34 of the first and second end stops 19, 20 have an abutment shoulder for contacting and stopping the travelling nut 25 which has a complementary abutment shoulder.

The first and second end stops 19, 29 each have a mounting part 35 for mounting the end stop assembly 17 to a rod (not shown). In this embodiment the mounting part 35 is designed as a bore for receiving a fixing means like a screw, pin, bolt, etc. The mounting part 35 and/or fixing means may interact with a rod (not shown) which is inserted in the hollow end stop assembly 17 through one of the end stop openings 36. Accordingly, each end stop opening 36 can serve as connector for connecting the end stop assembly 17 to a stationary component of the shading device 10.

According to FIG. 2 the travelling nut 25 is arranged in a mid region of the spindle between the first and second end stop 19, 20. Thus, the shade tube 11 may be driven to roll up or unroll the shade 13.

Figure 3:
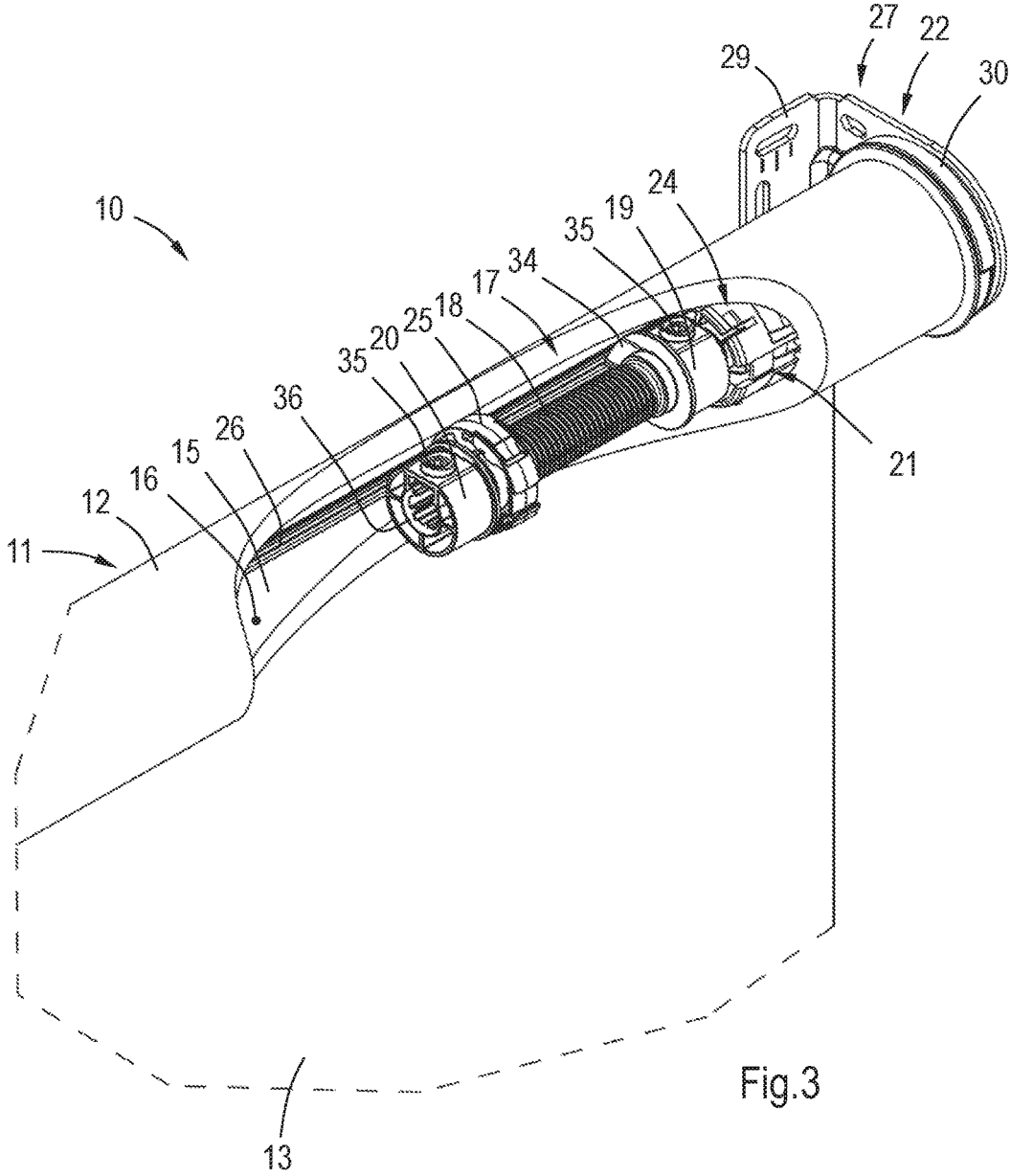
FIG. 3 is a further schematic perspective view of a section with partial removed elements of the shading device according to the invention.

FIG. 3 is a further schematic perspective view of a section with partial removed elements of the shading device 10 according to the invention. The travelling nut 25 interacts with the second end stop 20. More particularly, an abutment shoulder of the travelling nut 25 abuts a complementary abutment shoulder at the inner side 34 of the second end stop 20. Thus, the travelling nut 25 cannot be moved any further away from the first end stop 19. This position of the travelling nut 25 corresponds to the lower end stop position of the shade 13. In the lower end stop position of the shade 13, the shade 13 cannot be unrolled any further of the shade tube 11. Only a rotation of the shade tube 11 in an opposite direction to roll up the shade 13 is possible. Such a rotation of the shade tube 11 will move the travelling nut 25 along the spindle 18 towards the first end stop 19.

Figure 4:
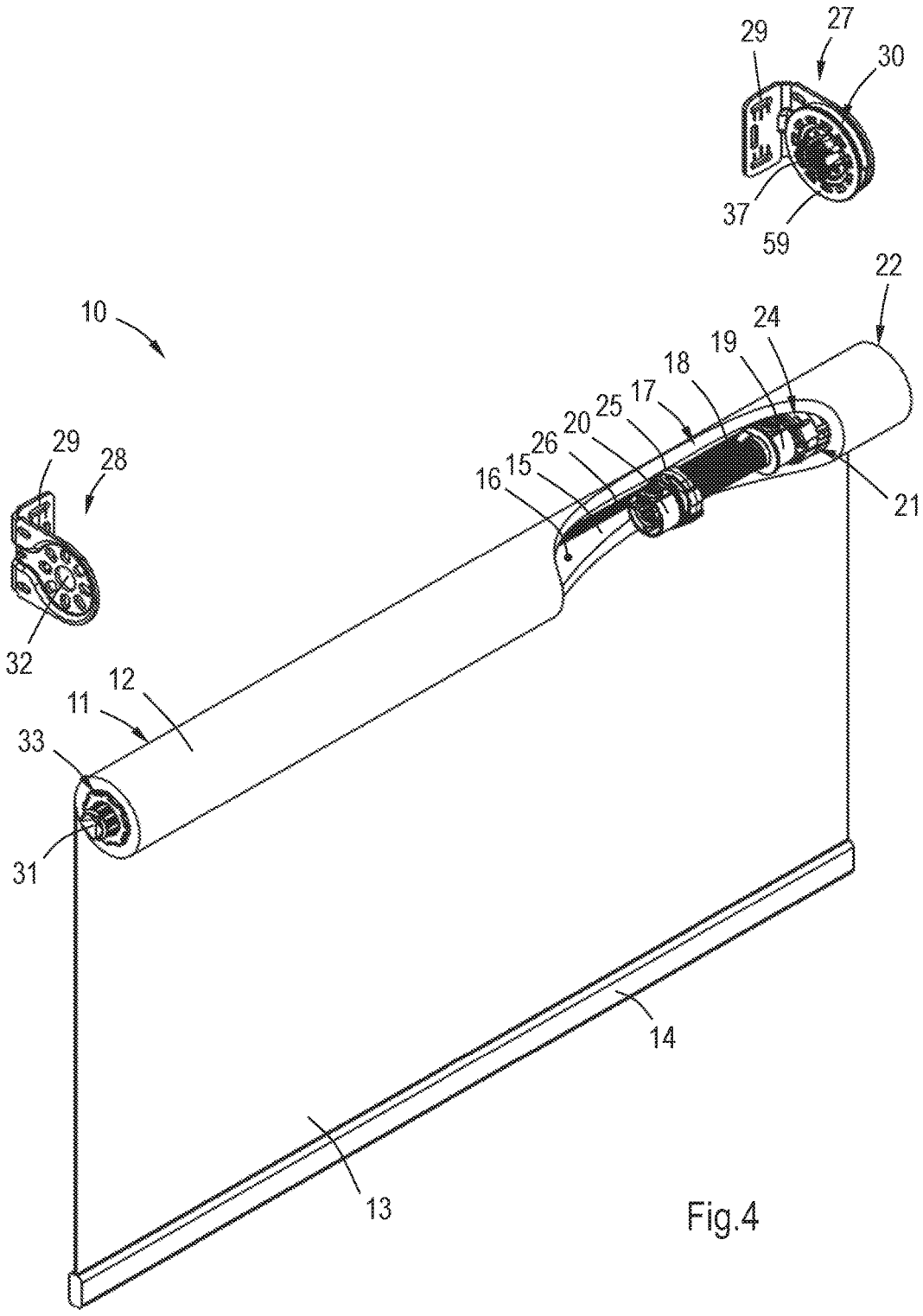
FIG. 4 presents a schematic perspective view with partial removed elements of a shading device according to the present invention disengaged from holding elements.

FIG. 4 presents a schematic perspective view with partial removed elements of a shading device 10 according to the present invention disengaged from holding elements 27, 28. As in FIG. 3 the travelling nut 25 is contacting the second end stop 20 and the shade 13 is in its lower end stop position. The arrangement according to FIG. 4 shows the shading device 10 in a setting position for setting or adjusting the lower end stop position of the shade 13. The disengagement from the holding elements 27, 28 allows to roll up or unroll the shade while rotating the shade tube 11 together with the end stop assembly 17 without any relative movement of the spindle 18 or the travelling nut 25 in regard to the shade tube 11. As a result the lower end stop position of the shade 13 is adjustable.

The holding element 27 has a fixing element 37. In this embodiment the mounting disc 30 comprises the fixing element 37 which is stationary coupled to the bracket 29. The fixing element 37 of the mounting disc 30 has as a recess for receiving and interacting with a correspondingly designed fixing element (not shown) of the end piece 21 for realizing a stationary connection of the end piece 21 with the holding element 27.

The fixing element 37 of the holding element 27 and the respective complementary fixing element of the end piece 21 have equidistantly and coaxially distributed fixing means (not shown) to allow several different orientations of the stationary end piece 21 relative to the stationary holding element 27. When disengaged from the holding element 27 the end piece 21 is rotatable to several discrete and equally distanced holding positions around a centre axis of the mounting disc 30 in which the end piece 21 is connectable to the holding element 27.

Furthermore, the mounting disc 30 includes a drive unit in the form of a drive wheel 59. The drive wheel 59 is rotatable mounted relative to the fixing element 37 of the mounting disc 30. For normal operation the drive wheel 59 is fixed to the shade tube 11 according to FIGS. 1 to 3. A cord or chain (not shown) may be arranged to the drive wheel 59. By driving the drive wheel 59 via a cord or chain the shade tube 11 can be driven around the centre axis of the shade tube 11 and the stationary end stop assembly 17.

Figure 5:
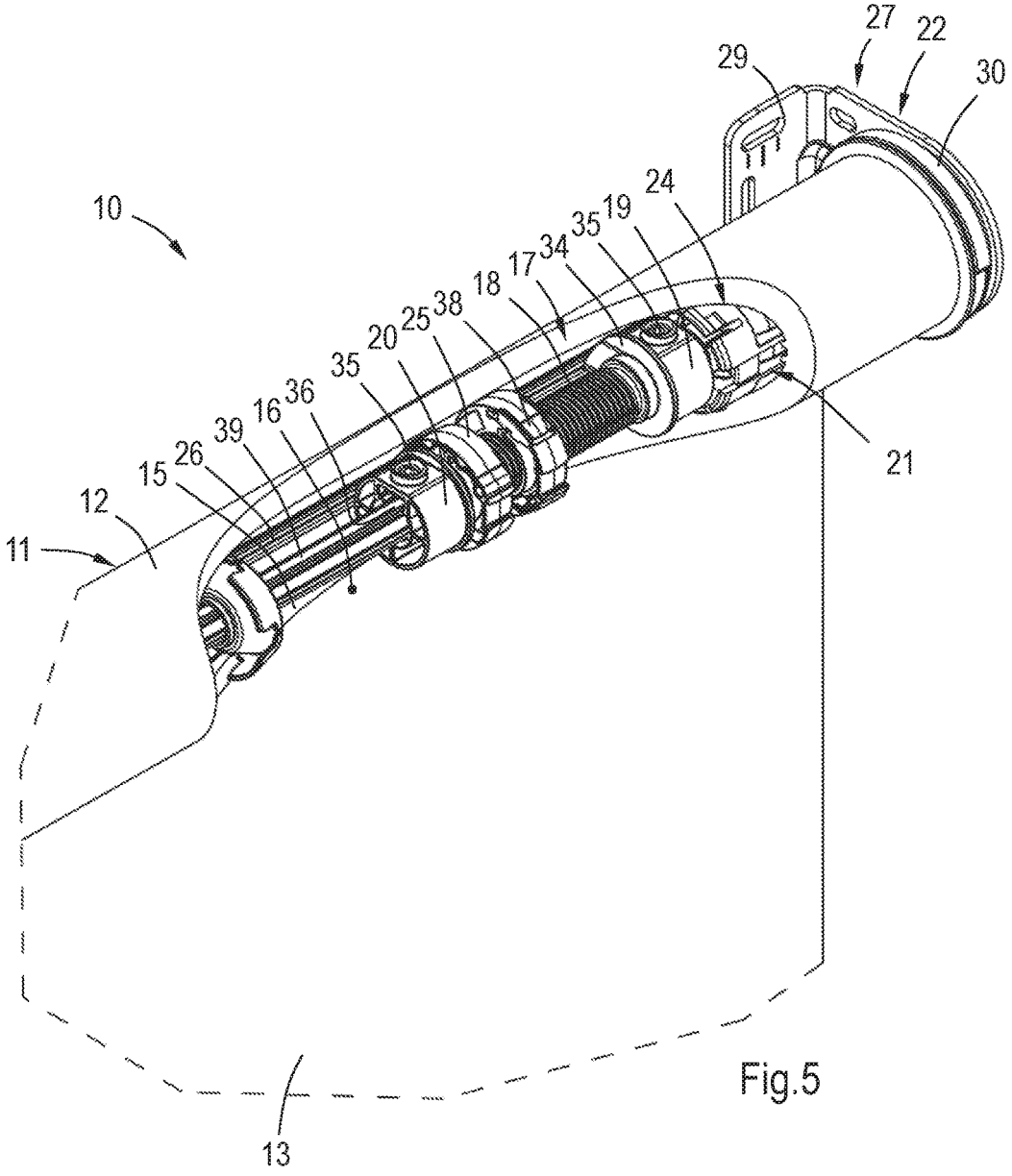
FIG. 5 is a further schematic perspective view of a section with partial removed elements of the shading device according to the invention with two travelling nuts.

FIG. 5 is a further schematic perspective view of a section with partial removed elements of the shading device 10 according to the invention with two travelling nuts 25, 38. First travelling nut 38 is assigned to the first end stop 19 for setting the upper end stop position of the shade 13. The second travelling nut 25 is assigned to the second end stop 20 for setting the lower end stop position of the shade 13. Both travelling nuts 25 and 38 are identically designed. The distance between the first and second travelling nut 25, 38 defines the length of the shade 13 which can be rolled on or up rolled from the shade tube 11. The smaller the distance between the first and second travelling nut 25, 38, the greater the windable length of the shade 13 is.

The second travelling nut 25 abuts according to FIG. 5 the second end stop 20 like in FIG. 3. Thus, the travelling nut 25 cannot be moved any further away from the first end stop 19. This position of the second travelling nut 25 corresponds to the lower end stop position of the shade 13. For reaching the upper end stop position of the shade 13, the shade tube 11 has to be rotated such that both travelling nuts 25, 38 are moving towards the first end stop 19. The upper end stop position of the shade 13 is reached when the first travelling nut 38 abuts the first end stop 19.

Additionally FIG. 5 shows a rod 39, which has not been shown in FIGS. 1 to 4 for clarity reasons, but which is also part of the embodiment of the present invention according to FIGS. 1 to 4 as well. The rod 39 is inserted through end stop openings 36 into the hollow end stop assembly 17 and through the hollow spindle 18. The end stop assembly 17 may be additionally fixed to the rod 30 by the mounting parts 35. The rod 39 is stationary coupled to the holding elements 27, 28. The rod 39 forms a stationary central axis of the shading device 10 around which the shade tube 11 is rotatable in normal operation of the shading device 10. In this embodiment the rod 39 is part of a counterbalance unit.

Figure 6:
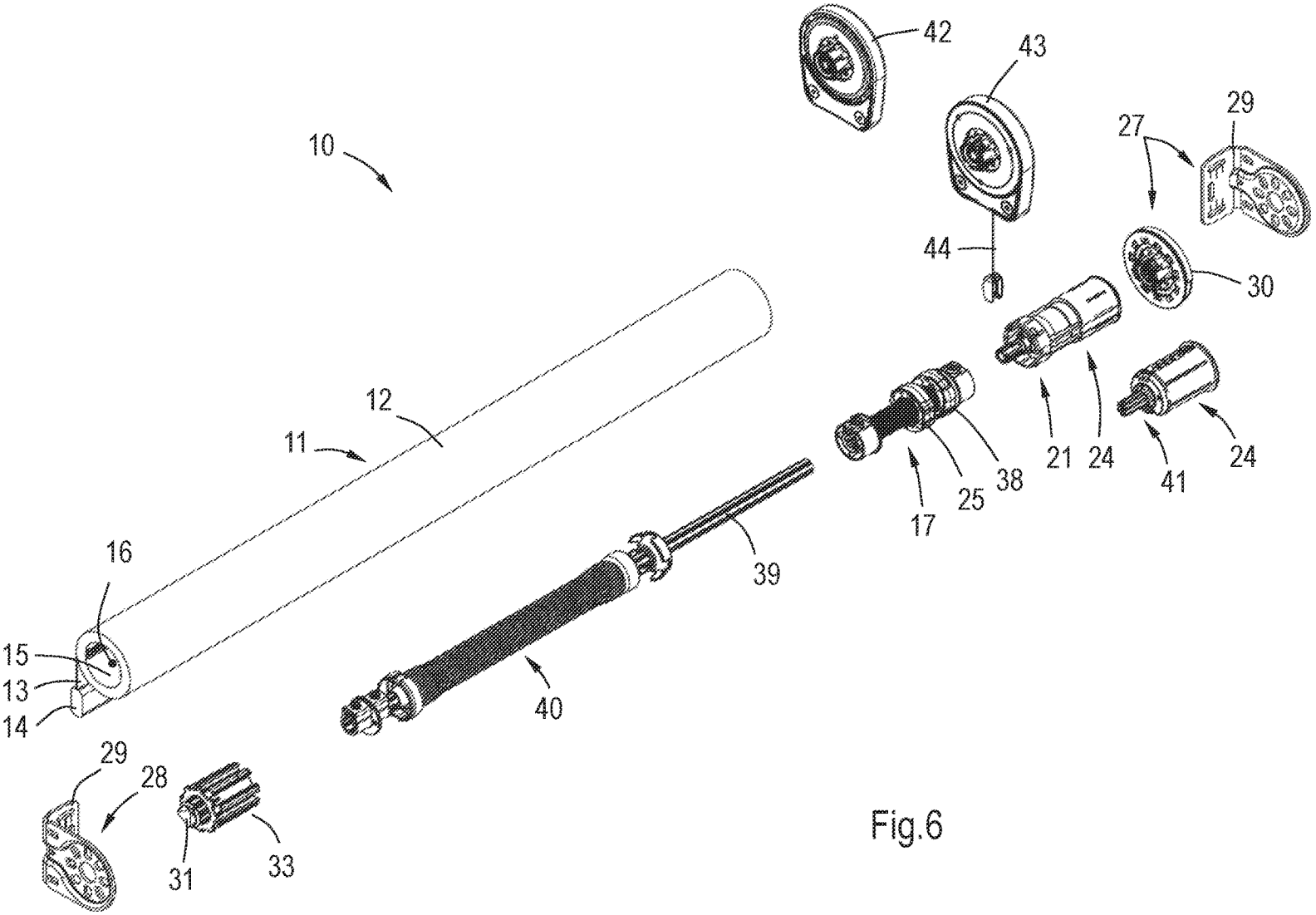
FIG. 6 is an exploded view of a shading device according to the present invention.

FIG. 6 is an exploded view of a shading device 10 according to the present invention. In this embodiment the end stop assembly 17 has two travelling nuts 25, 38. In an alternative embodiment the end stop assembly 17 may have only a single travelling nut 25.

The shading device 10 comprises a counterbalance unit 40. The counterbalance unit 40 serves for balancing the shade 13 in every desired position of the shade 13.

The end piece 21 may be replaced by an alternative end piece 41. The end pieces 21, 41 comprise a break device for slowing down or braking the rotation of the shade tube 11. According to a further alternative end piece 21 may be replaced by an adapter, particularly in the form of end piece 41, but without a break device. End pieces 21 and 41 both have a stationary fixing element and a bearing 24.

Mounting unit 42 or 43 may be used as an alternative to mounting disc 30. The mounting units 42, 43 are designed to be mounted on the inner face of the brackets 29 like the mounting disc 30. In this embodiment the mounting units 42, 43 are drive units configured to drive the shade tube 11. For this purpose the mounting unit 43 has a cord 44. Pulling the cord 44 activates a drive means coupled with the shade tube 11. The mounting unit 42 needs an additional chain (not shown) to drive a drive means to rotate the shade tube 11. The drive means of the mounting units 42, 43 are rotatable to a stationary fixing element 37 of the mounting units 42, 43 which may be similar to the fixing element 37 of the mounting disc 30.

Figure 7:
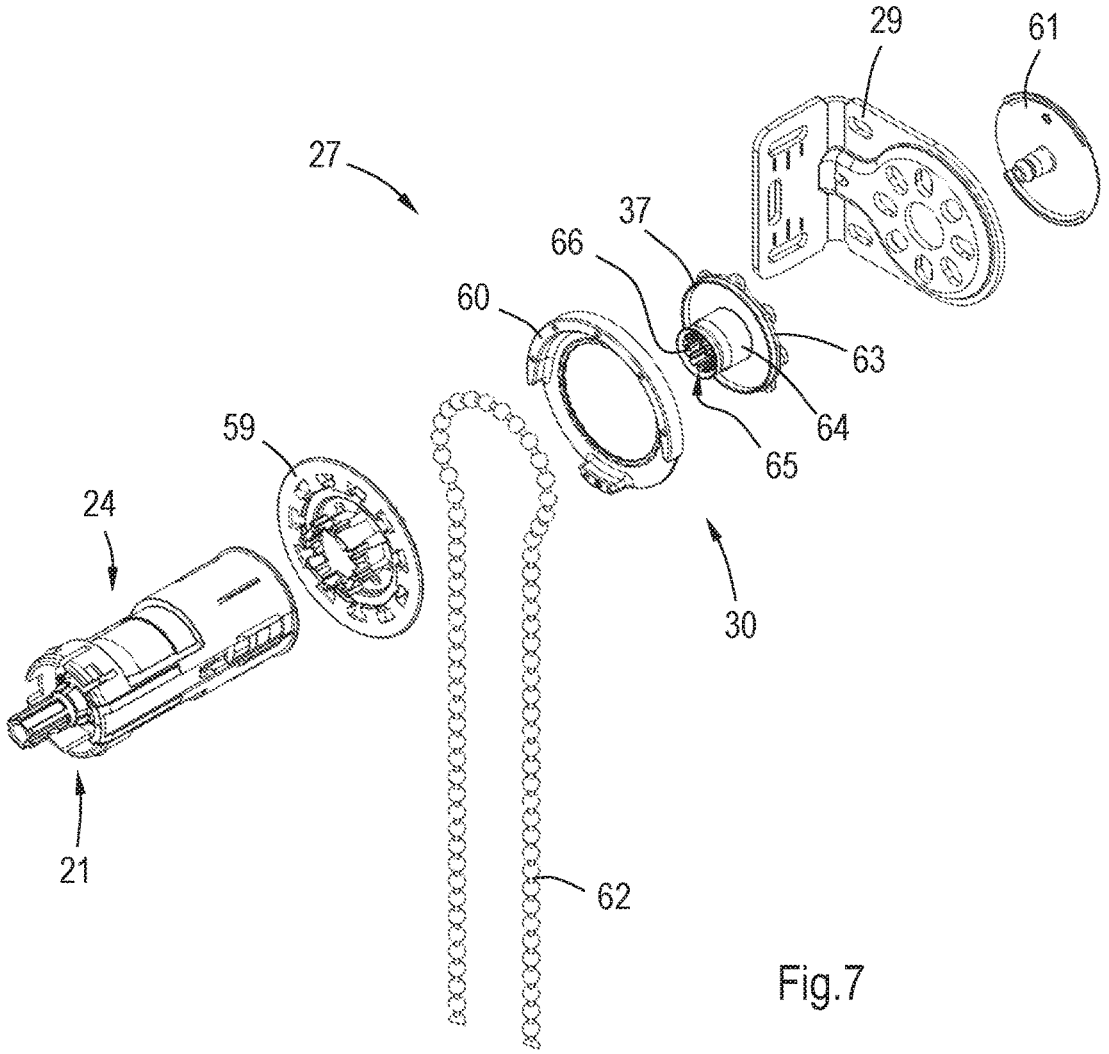
FIG. 7 is an exploded view of a holding element with an end piece for a shading device according to the invention.

FIG. 7 is an exploded view of the holding element 27 with the end piece 21 for a shading device 10 according to the invention. In detail the mounting disc 30 of the holding element 27 is shown in an exploded view. The mounting disc 30 comprises the drive wheel 59, a bearing ring 60, the fixing element 37 and a mounting cover 61.

A ball chain 62 is provided for arrangement around the drive wheel 59. The fixing element 37 has a mounting plate 63. The mounting plate 63 has a tube like projection 64. The projection 64 provides a recess 65. The inner side of the recess 65 has several fixing means 66. For clarity not all fixing means 66 have a reference numeral. In this embodiment the fixing means 66 of the fixing element 37 are formed as bars extending longitudinal to the projection 64.

For assembling the mounting disc 30 to the bracket 29 the mounting cover 61 is arranged at the outer side of bracket 29. Then the fixing element 37 is coupled with its mounting plate 63 to the inner side of the bracket 29 and coupled with the mounting cover 61. Thus, the fixing element 37 is stationary mounted to the bracket 29. The drive wheel 59, ball chain 62 and bearing ring 60 form a drive unit which is attachable to the bracket 29 and the fixing element 37. The drive wheel 59 is rotatable to the bearing ring 60 and the fixing element 37.

Figure 8:
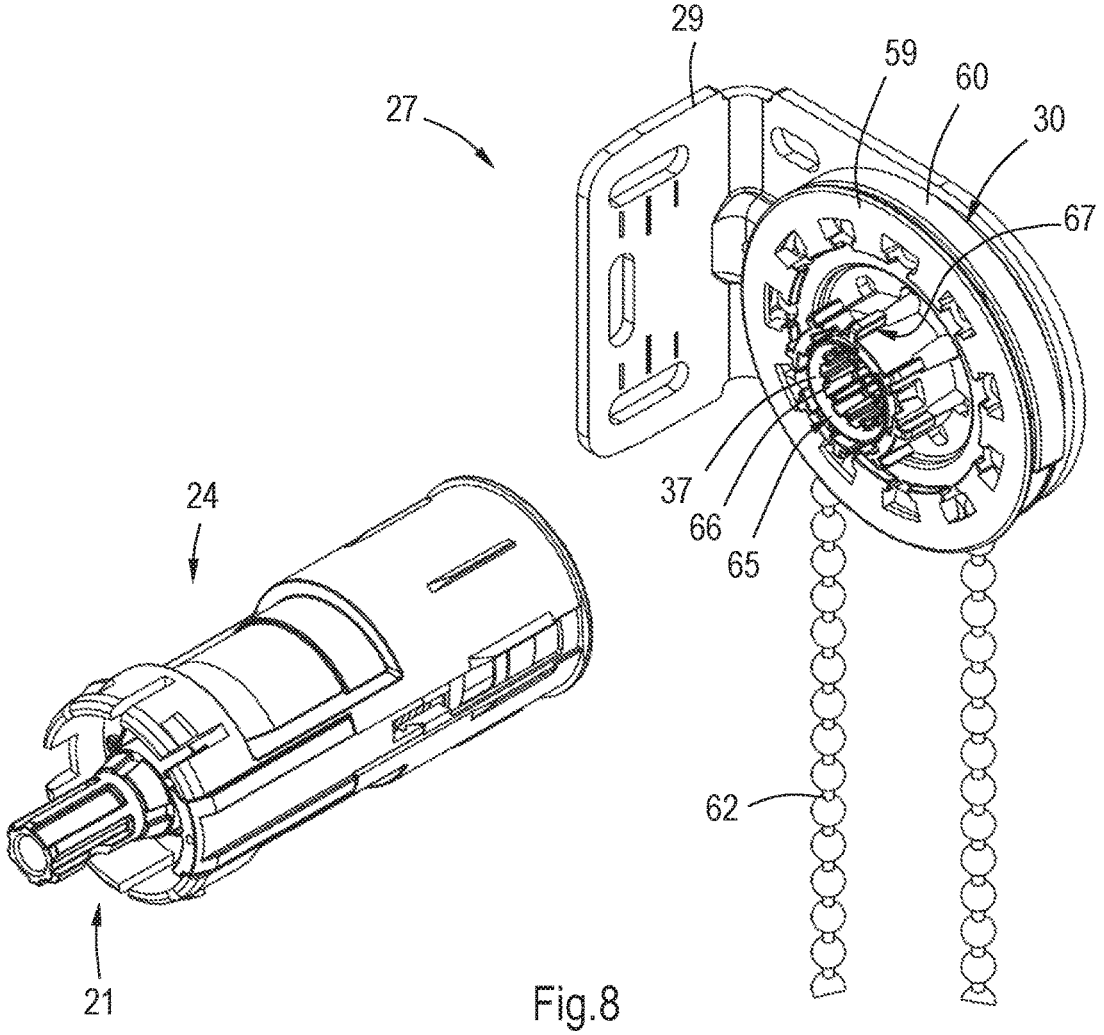
FIG. 8 is a first perspective view of an assembled holding element and an end piece according to FIG. 7.

FIG. 8 is a first perspective view of an assembled holding element 27 and the end piece 21 according to FIG. 7. By pulling at one side of ball chain 62 the ball chain 62 and the drive wheel 59 which is coupled with the ball chain 62 rotates around the fixing element 37. The drive wheel 59 has several coupling members 67 for coupling the drive wheel 59 to the inner side of the bearing 24 of end piece 21.

Figure 9:
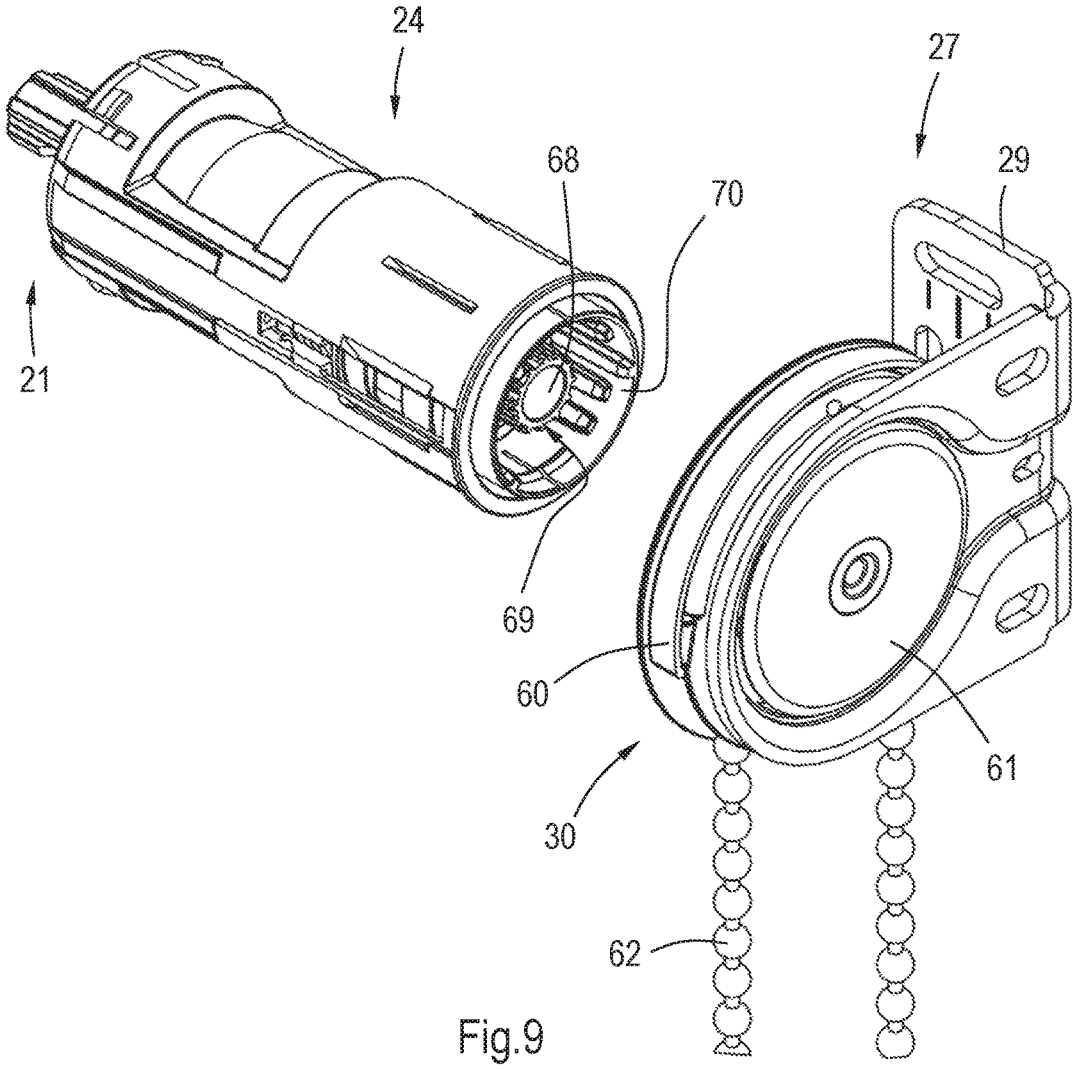
FIG. 9 is a second perspective view of an assembled holding element and an end piece according to FIG. 8.

FIG. 9 is a second perspective view of the assembled holding element 27 and the end piece 21 according to FIG. 8. The end piece 21 has a fixing element 68. The fixing element 68 of end piece 21 is stationary. In this embodiment the fixing element 68 is formed as a stick. The fixing element 68 is surrounded by the bearing 24 which is rotatable around the fixing element 68. At the outer circumference of the fixing element 68 are several fixing means 69. For clarity not all fixing means 69 have a reference numeral. According to this embodiment the fixing means 69 are designed as grooves.

The fixing means 69 of the end piece 21 are complementary formed to the fixing means 66 of the fixing element 37 of the holding element 27. Fixing means 66 and 69 are equidistantly distributed around the centre axis of the fixing element 37 and 68 respectively. Fixing element 68 of end piece 21 can be inserted into the recess 65 of the fixing element 37 to establish a stationary coupling between end piece 21 and the holding element 27. Because of the several fixing means 66 and 69 several different holding positions of the end piece 21, namely the fixing element 68, relative to the holding element 21, namely the fixing element 37, are realizable. Dependent of the amount of fixing means 66, 69 the fixing element 68 is connectable with the fixing element 37 in predetermined angle increments around the centre axis of the end piece 21. This allows a precise adjustment of the lower and/or upper end stop position of the shade 13.

The inner side of the bearing 24 has several coupling members 70 which are complementary to the coupling members 67 of the drive wheel 59. By establishing the connection between both fixing elements 37 and 68 the coupling members 67, 70 are also coupled with each other.

Figure 10:
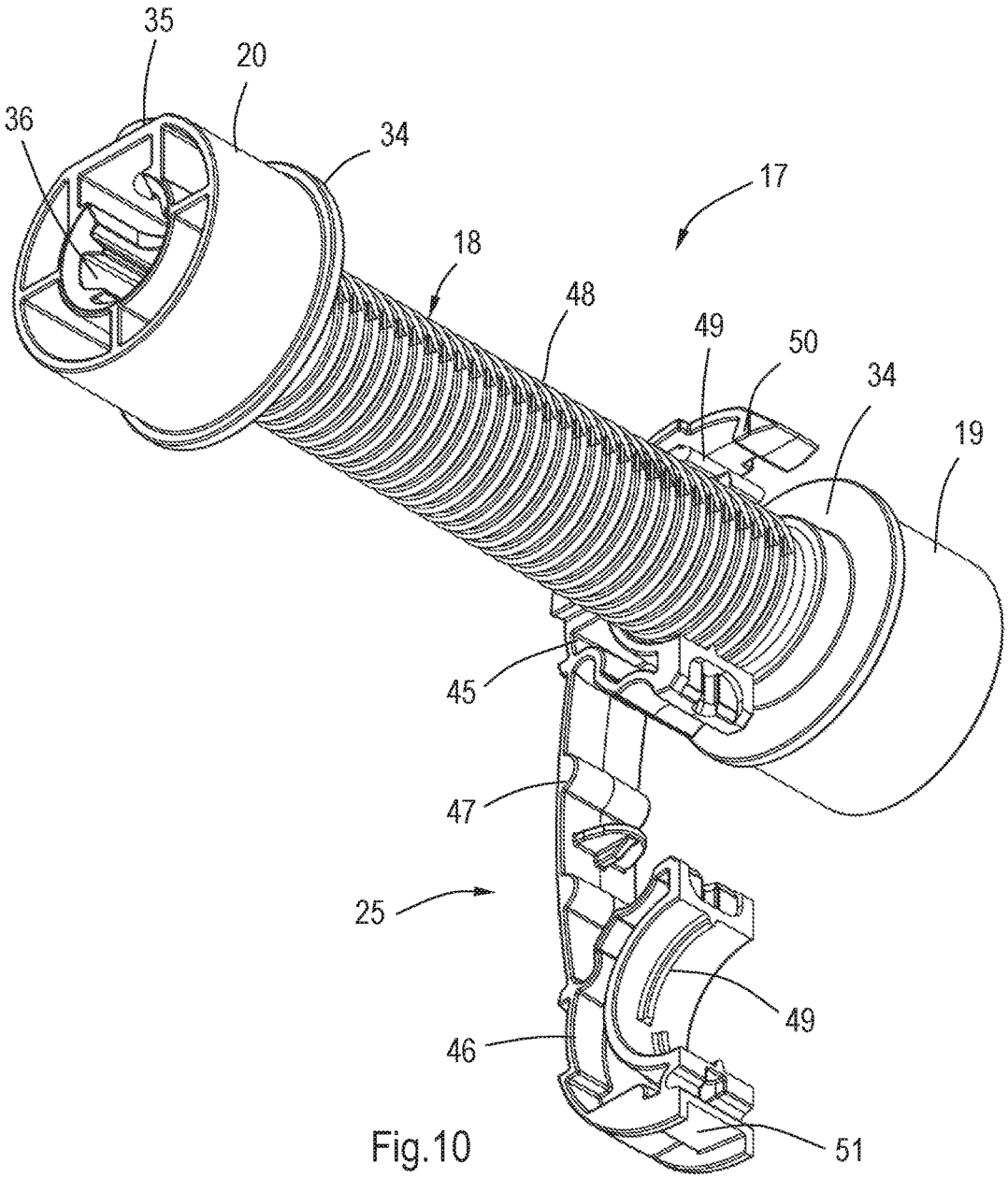
FIG. 10 is a schematic perspective view of an end stop assembly for a shading device according to the present invention with a travelling nut in an opened position.

FIG. 10 is a schematic perspective view of an end stop assembly 17 for a shading device 10 according to the present invention with a travelling nut 25 in an opened position. Travelling nuts 25 and 38 may (but need not) be identical. The following description of travelling nut 25 applies also to travelling nut 38.

The travelling nut 25 is has articulated segments. More particularly, it comprises two segments 45, 46 which are hingedly connected by a flexible hinge 47. In this embodiment, the segments 45, 46 are designed as a first half 45 and a second half 46 respectively of the travelling nut 25. The flexible hinge 47 allows to flip open the travelling nut 25 for arranging the travelling nut 25 around the spindle 18. The flexible hinge 47 is according to this embodiment substantially made as a flexible plastic strip which is flexibly connected with the two halves 45, 46.

For engaging the travelling nut 25 around the spindle 18 the travelling nut 25 is in its open position and half 45 is arranged to the spindle 18 such that the external thread 48 of the spindle 18 mates with the internal thread 49 of the half 45.

The first half 45 of the travelling nut 25 has a first joint element 50 and the second half 46 of the travelling nut 25 has a second joint element 51. The joint elements 50, 51 are formed complementary to each other for realizing an engagement with each other. By engaging both joint elements 50, 51 with each other the two halves 45, 46 are connected to realize a closed position of the travelling nut 25.

Figure 11:
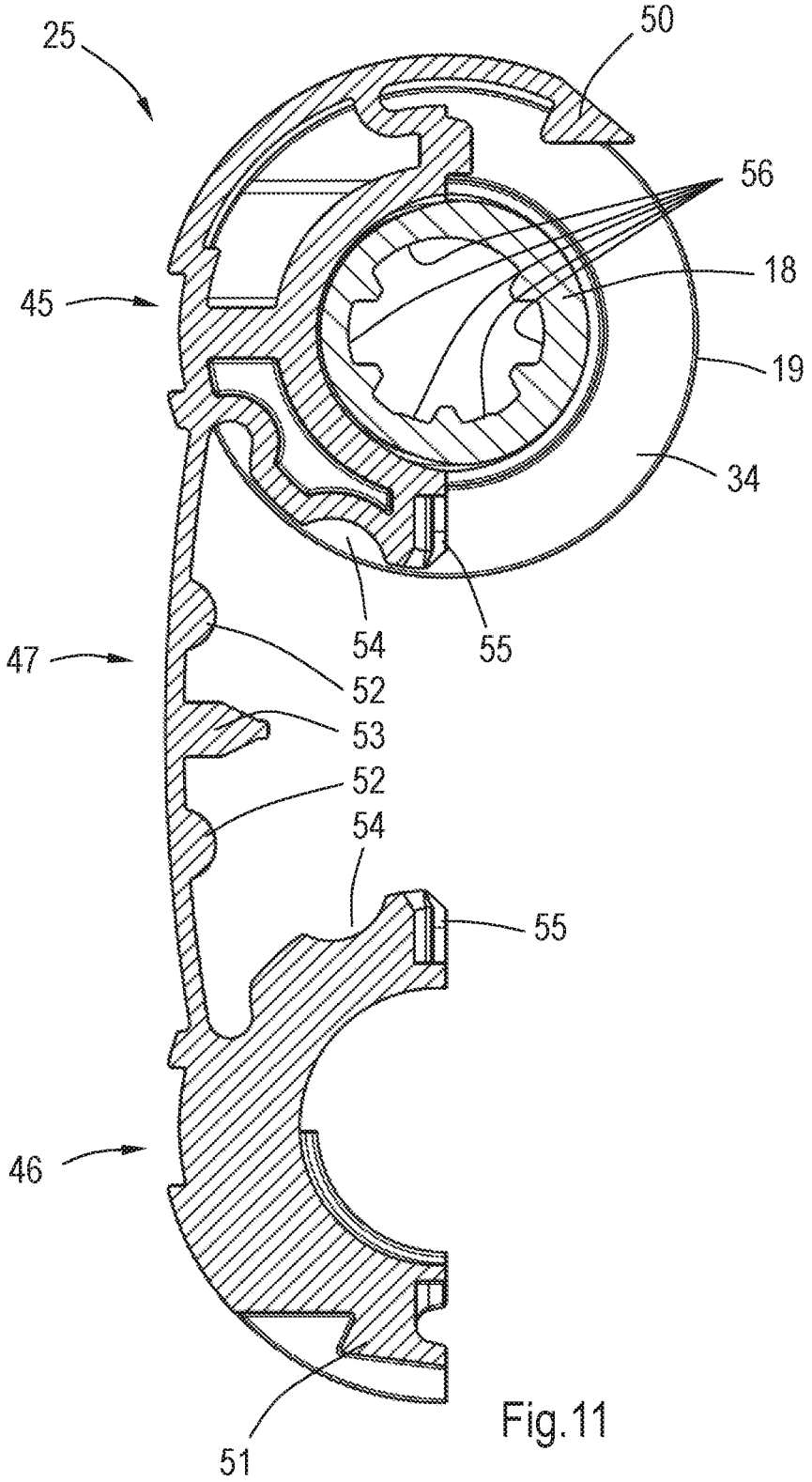
FIG. 11 is a schematic cross section of the end stop assembly with the travelling nut in the opened position according to FIG. 10.

FIG. 11 is a schematic cross section of the end stop assembly 17 with the travelling nut 25 in the opened position according to FIG. 10. According to this embodiment the first joint element 50 is designed as a snap-on catch and the second joint element 51 is designed as a recess complementary formed to the snap-on catch.

As the flexible hinge 47 is made as a flexible strip the two halves 45, 46 are displaced from each other in the opened position of the travelling nut 25. The flexible hinge 47 has several formations 52, 53 which mate with complementary formed formations 54, 55 on the halves 45, 46 in a closed position of the travelling nut 25.

The end stop openings 36 and the hollow spindle 18 have several grooves 56 at the inner side of a tube section of the end stop assembly 17. These grooves 56 mate with complementary formed bars of a rod 39 for avoiding any rotation of the end stop assembly 17 relative to the rod 39.

Figure 12:
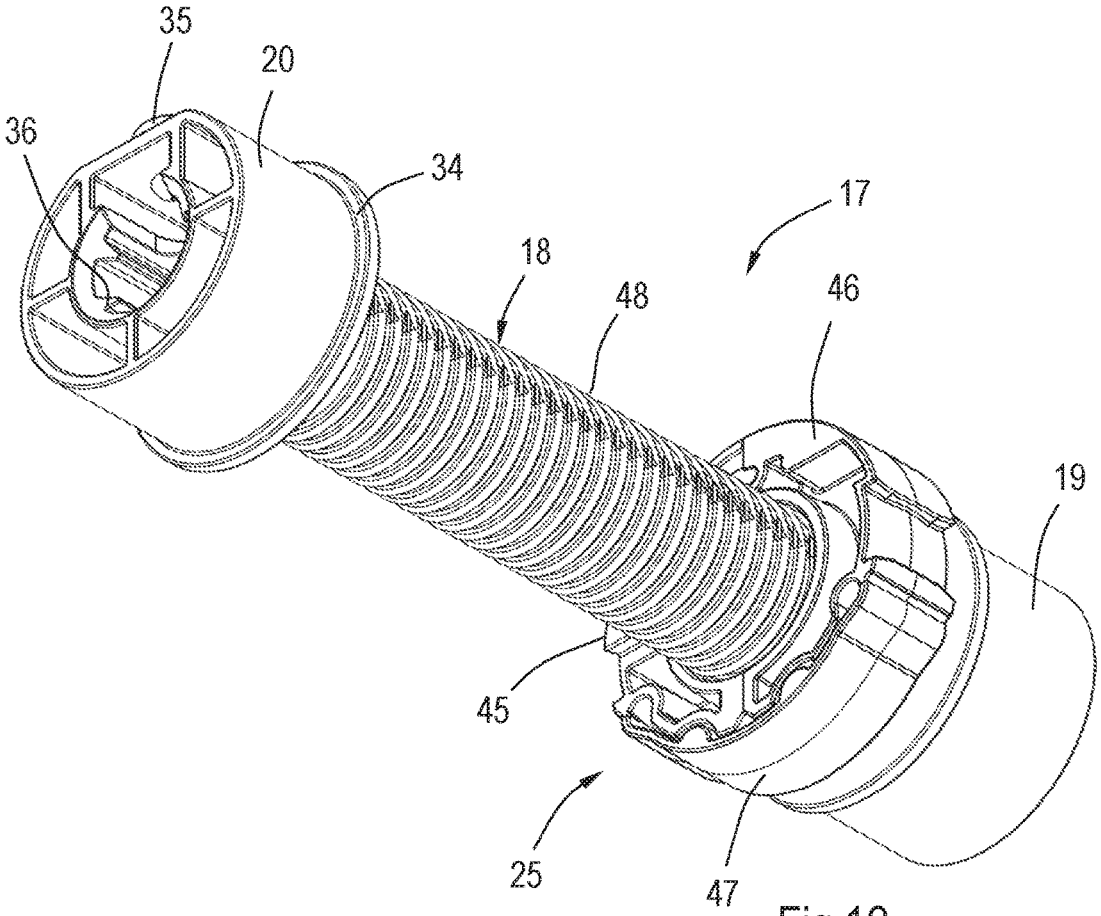
FIG. 12 is a further schematic perspective view of an end stop assembly for a shading device according to the present invention with a travelling nut in a closed position.

FIG. 12 is a further schematic perspective view of the end stop assembly 17 for the shading device 10 according to the present invention with the travelling nut 25 in a closed position. In comparison to FIG. 11 the travelling nut half 46 has been swung with the flexible hinge 47 around the spindle 18 for coupling the nut halves 45, 46 with each other. In the closed position of the travelling nut 25 the two halves 45, 46 form a ring shaped travelling nut 25. The travelling nut 25 is moveably guided on the spindle 18.

Figure 13:
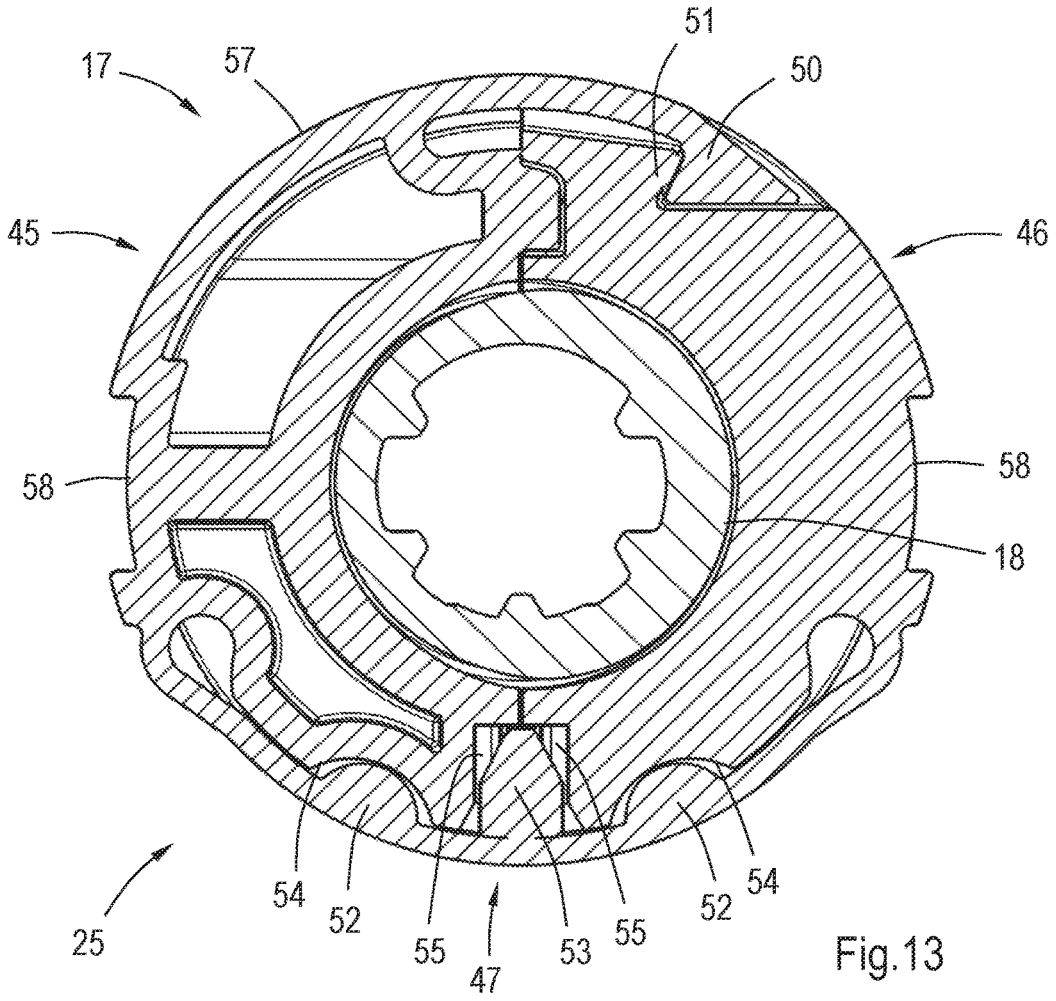
FIG. 13 is a schematic cross section of the end stop assembly with the travelling nut in the closed position according to FIG. 12.

FIG. 13 is a schematic cross section of the end stop assembly 17 with the travelling nut 25 in the closed position according to FIG. 2. The snap-on catch 50 is snapped on the correspondingly formed recess 51. Thus, the halves 45, 46 of the travelling nut 25 are detachable joined with each other.

The flexible hinge 47 is aligned to the travelling nut 25, whereby the formations 52 and 53 engage the formations 54 and 55 respectively. An outer surface 57 of the travelling nut 25 contacts the inner surface 15 of the inner cavity 16 when the end stop assembly 17 with the closed travelling nut 25 is inserted into the shade tube 11. In this case the connection between the two halves 45, 46 cannot be unintentionally opened. The contact of the outer surface 57 of the travelling nut 25 with the inner surface 15 of the inner cavity 16 prevents a unintended opening of the travelling nut 25.

The outer surface 57 of the travelling nut 25 has engaging elements 58. In this embodiment the travelling nut 25 has two engaging elements 58 which are formed as grooves. The engaging elements 58 are assigned to the first half 45 and the second half 46 respectively. When the end stop assembly 17 with the travelling nut 25 is inserted into the inner cavity 16 of the shade tube 11, the engaging elements 58 engage a complementary element in the inner surface 15 of the shade tube. In this embodiment this complementary element is formed as a bar 25 as shown in FIGS. 1 to 5.

Although preferred embodiments of the present invention and modifications thereof have been described in detail herein, it is to be understood that this invention is not limited to these precise embodiments and variations and may be effected by one skilled in the art without departing from the spirit and scope of the invention as defined by the appended claims.

The use of expressions like: "particularly", "preferably" or "especially preferred" etc. is not intended to limit the invention. Features which are not specifically or explicitly described or claimed may be additionally included in the structure or method according to the present invention without deviating from its scope.

The invention claimed is:

1. A method for adjusting at least one end stop position of a shade of a shade device comprising a drive unit for extending and retracting the shade between an extended end position and a retracted end position; a spindle having a longitudinal axis; an extended end stop, fixedly connected to the spindle near a first end of the spindle; a travelling nut, movably arranged on the spindle and operatively connected to the drive unit so as to move towards and away from the extended end stop along the longitudinal axis of the spindle as the shade is extended and retracted, respectively; a winding core for receiving wound layers of a flexible element during extending and retracting of the shade, the winding core having an inner surface defining an inner cavity, and the spindle being disposed within this inner cavity; and an end piece arranged at an end of the inner cavity of the winding core for mounting the winding core to a holding element for mounting to a building structure; said method comprising:

mounting the end piece to the holding element;

rotating the winding core to the extended end stop position of the shade at which the travelling nut interacts with the extended end stop of the spindle to prevent additional movement of the travelling nut towards the extended end stop and to prevent further movement of the winding core and the shade relative to the travelling nut;

disengaging the end piece from the holding element to enable movement of the shade relative to the winding core while the travelling nut remains in position at the extended end stop;

setting a desired shade length by rotating the disengaged winding core together with the end stop assembly around a longitudinal axis of the winding core for winding or unwinding the shade from the winding core; and re-establishing a connection between the end piece and the holding element, the holding element mounted to the building structure.

2. The method according to claim 1, wherein during rotating of the winding core together with the end stop assembly, the travelling nut maintains its position in relation to the spindle.

3. The method according to claim 1, wherein the shade device is provided with a retracted end stop fixedly connected to the spindle near a second end of the spindle.

4. The method according to claim 3, wherein, prior to mounting the end piece to the holding element, the end stop assembly is inserted into the inner cavity of the winding core with the shade in its retracted end position and the travelling nut interacting with the retracted end stop.

5. The method according to claim 3, further comprising moving the travelling nut on the spindle between the extended and retracted end stops.

6. The method according to claim 5, wherein the travelling nut interacts with the extended end stop to set the extended end position of the shade and the travelling nut interacts with the retracted end stop to set the retracted end position of the shade.

7. The method according to claim 3, wherein the travelling nut comprises a first travelling nut and a second travelling nut movably arranged on the spindle between the extended and retracted end stops.

8. The method according to claim 7, further comprising setting the extended end position of the shade by the first travelling nut interacting with the extended end stop and setting the retracted end position of the shade by the second travelling nut interacting with the retracted end stop.

9. The method according to claim 1, further comprising connecting the spindle, the extended end stop, and the travelling nut to a stationary rod, the spindle, the extended end stop, and the travelling nut forming an end stop assembly.

10. The method according to claim 1, wherein the winding core is a cord spool or a shade tube.

11. The method according to claim 1, wherein the flexible element is a lift cord or the shade.

12. The method according to claim 1, wherein the holding element is a bracket.

13. The method according to claim 1, wherein the travelling nut is configured to be coupled to the spindle in a direction transverse to the longitudinal axis of the spindle.

* * * * *